United States Patent [19]

Eddy

[11] 4,351,472

[45] Sep. 28, 1982

[54] CLOSURE

[75] Inventor: William R. Eddy, Kansas City, Mo.

[73] Assignee: Phillips Petroleum Company, Bartlesville, Okla.

[21] Appl. No.: 164,875

[22] Filed: Jul. 1, 1980

Related U.S. Application Data

[63] Continuation of Ser. No. 822,777, Aug. 8, 1977, abandoned.

[51] Int. Cl.[3] ..... B65D 5/64; B65D 21/02; B65D 43/03; B65D 43/08

[52] U.S. Cl. ..... 229/43; 206/45.31; 206/503; 206/520; 229/56

[58] Field of Search ..... 206/45.31, 503, 520; 229/5.6, 43

[56] References Cited

U.S. PATENT DOCUMENTS

| | | | |
|---|---|---|---|
| 709,017 | 9/1902 | Kuechenmiester | 229/5.6 |
| 1,587,544 | 6/1926 | Moore . | |
| 1,627,047 | 3/1927 | Moore . | |
| 2,179,231 | 11/1939 | Moore | 229/43 |
| 2,576,650 | 11/1951 | Sonnenborg | 206/45.31 |
| 2,721,686 | 10/1955 | Riefsnyder | 206/45.31 |
| 2,842,301 | 7/1958 | Albert | 229/5.6 |
| 3,091,360 | 5/1963 | Edwards | 206/520 |
| 3,447,734 | 6/1969 | Wilcox | 229/43 |

FOREIGN PATENT DOCUMENTS

| | | | |
|---|---|---|---|
| 22536 | of 1907 | United Kingdom | 229/5.6 |

*Primary Examiner*—George E. Lowrance

[57] ABSTRACT

A two-piece closure with a skirt portion surmounted by an upstanding flange having integral extended parts at least in the shape of an inverted U and a disc portion having an at least upward projection at the disc's periphery with this projection substantially confined between the integral extended parts of the upstanding flange portion. The upstanding flange portion confining the projection is swaged with an imprinted crimp design on its surfaces so that it is offset radially inwardly from the skirt portion to form a shoulder sufficiently wide to accomodate a duplicate skirt portion stacked thereon. In a preferred embodiment the integral extended part of the upstanding flange has two 180° folds and the projection at the disc's periphery is extended in the shape of an inverted U with the upstanding flange and projection interfolded to interlock.

8 Claims, 5 Drawing Figures

CLOSURE

This application is a continuation of copending application Ser. No. 822,777, filed Aug. 8, 1977, now abandoned.

BACKGROUND OF THE INVENTION

This invention relates to a novel closure. In one of its aspects this invention relates to a stackable closure. In another of its aspects this invention relates to a partially nestable closure. In still another of its aspects this invention relates to a closure having a disc portion interlocked with a skirt portion. In still another of its aspects this invention relates to a closure having a crimped, offset, upstanding flange portion.

Closures that cannot be stacked offer multiple difficulties in being difficult to ship in quantity and in requiring special handling when being applied to containers automatically. It can easily be seen that closures that will stack or partially nest are more convenient to pack for shipping and handle in applying the closures to containers. Even with currently used stackable or nestable closures, however, problems arise in trying to use simple, vaccum-type feeding devices. A closure that is of sturdy construction and shaped to facilitate destacking or denesting with vacuum-type feeding devices has now been developed.

It is therefore an object of this invention to provide a two-piece closure of sturdy construction. It is another object of this invention to provide a stackable or nestable two-piece closure that can be easily destacked or denested.

Other aspects, objects, and the various advantages of this invention will become apparent upon study of this specification, the drawing, and the appended claims.

STATEMENT OF THE INVENTION

According to this invention a two-piece closure is provided having a skirt portion surmounted by an integral extended part in the shape, at least, of an inverted U forming an upstanding flange and also having a disc portion that has at its periphery, at least, an upward projection substantially confined within the inverted U of the upstanding flange. In addition, the upstanding flange confining the projection is swaged with an imprinted crimp design on the flange surfaces thereby offsetting the flange portion radially inwardly from the skirt portion at a point between the base of the skirt portion and the top of the flange portion to form a shoulder that is sufficiently wide to accomodate a duplicate skirt portion stacked thereon providing a partial nesting of duplicate stacked closures.

In a preferred embodiment the integral extended part of the upstanding flange is made of two 180° folds and the projection at the disc's periphery is extended in the shape of an inverted U with the upstanding flange and projection interfolded to interlock. In this configuration the portion of the upstanding flange extending from the second 180° fold is confined by the inverted U of the projection of the disc's periphery with this inverted U in turn confined by the portion of the upstanding flange on either side of the first 180° fold. This configuration produces an interlocking of the central disc portion and the skirt of the closure.

The materials used in constructing the closures of this invention will generally be a paper product. The various plastic coated paperboards commonly used in container construction are particularly suitable for forming these closures.

The great advantage of the closures hereindescribed is that the closures which are stackable and partially nestable can be easily used with presently available, vacuum destacking and denesting equipment. The imprinting of a crimp design on the swaged portion—the upstanding flange portion—of the closure permits the free entry of air between the nested closures so that when the top closure on a stack is removed by automatic equipment the next closure in the stack is not disturbed from its position by a suction between it and the closure being removed.

Crimping has another advantage in that the usual swaging operation on a paper base material produces wrinkles in the area that is decreased in size. These wrinkles are entirely unsymmetrical and are, therefore, decidedly unaesthetic. The crimping pattern takes up the material that would become unsightly wrinkles and uses this material to produce a pleasant pattern that is decidedly more pleasing to the eye.

The invention can best be understood in conjunction with the drawing in which.

Figure 2:
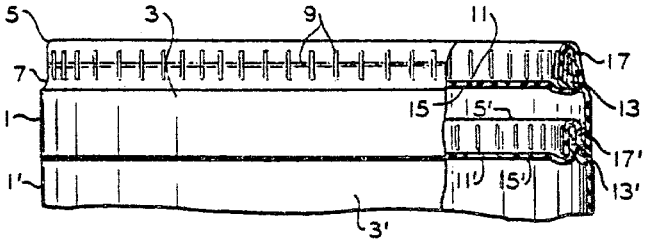
FIG. 2 is a partially cutaway side view of two stacked partially nested closures.

Referring now to FIG. 2, the two closures 1, 1' are shown in a stacked, partially nested position. In this position the skirt 3, 3' fits over the swaged, upstanding flange portion 5, 5' of the subadjacent closure to rest on the shoulder 7, 7' of the subadjacent closure.

The imprinted crimp design 9 on the outside of the upstanding flange portion and the imprinted crimp design 11, 11' on the inside of the upstanding flange portion are produced in a swaging action that reduces the size of the upstanding flange portion 5, 5' thereby taking up excess material that would otherwise turn to a random wrinkling of these surfaces during the swaging action.

Figure 4:
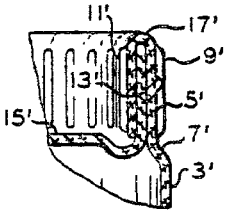
FIG. 4 is a detailed cutaway side view of a crimped flange portion united with a disc portion.

In the cutaway portion of FIG. 2, the projection 13' of the periphery of the disc 15' of closure 1' is shown confined between the integral extended part 17' in the shape of an inverted U of the upstanding flange portion 5' extending above the skirt 7'. This configuration is shown in greater detail in FIG. 4 using the same numbers and also shows imprinted crimp 9' in an "H" pattern on the outside of the upstanding flange and the imprinted crimp 11' in an "I" pattern on the inside of the upstanding flange. In this configuration some form of adhesive would be necessary on the adjacent faces of the upper projection 13' and the inverted U 17' to assure that the disc portion 15' was sturdily secured to the skirt portion 7'.

Figure 5:
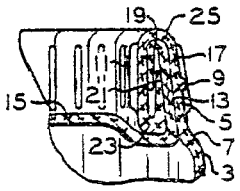
FIG. 5 is a detailed cutaway side view of the disc portion interlocked with the upstanding flange portion.

Similarly the detail of FIG. 5 shows the disc portion 15 with its upward projection 13 at the disc's periphery extended around a 180° fold 19. This 180° fold confines the end 21 of the integral extended part 17 of the upstanding flange 5 which with two 180° folds 23, 25 in turn confines and interlocks with the upward projection 13 of the disc 15. In this configuration adhesive should not be needed to assure sufficient interlock of the disc and upstanding flange, but adhesive can be used if desired. It will be noted in the figure that the extended ends seem to narrow near the extremities after the folds. This is a result of the folding which tends to alter the shape of the extremities of a folded paper product. The imprinted crimp design 9 on the outside of the upstanding flange 5 and the imprinted crimp design 11 on the inside of the upstanding flange 5 demonstrate the proportions of the material that is modified from random wrinkling on the surface to imprint a design during the swaging process.

Figure 1:
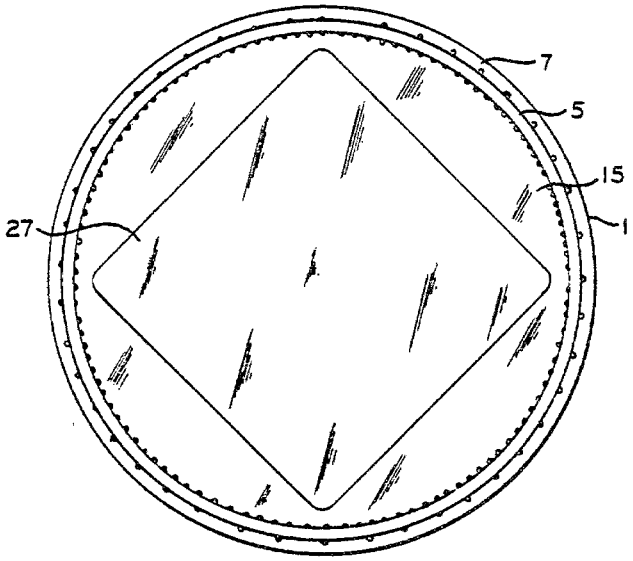
FIG. 1 is a top view of a closure with a swaged flange portion.

Referring now to FIG. 1 the relative proportions of the upstanding flange 5 and the offset shoulder 7 in relation to the overall disc portion 15 of the closure can be seen. The top illustrated contains a window 27 which is included to illustrate that windowed closures are particularly advantageously adapted with the reinforcement of the interlocking upstanding portion as illustrated in FIG. 5 to give added strength to the closure. The windowed closure may be left with an opening in the closure or may be covered on the underside with an adhered sheet of clear or colored plastic.

Figure 3:
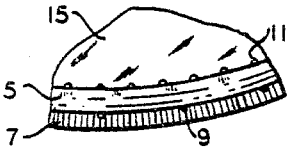
FIG. 3 is a top view detail of a crimp pattern on the swaged flange portion.

The detail of FIG. 3 illustrates the relationship of the imprinted crimp design 9 on the outside of the upstanding flange 5 and the imprinted crimp design 11 on the inside of the upstanding flange 5. There are, of course, more imprinted crimps on the inside which is swaged to a smaller size than on the outside since there is, therefore, more excess material to be taken up on the inside of the flange than on the outside.

I claim:

1. A two-piece paper product closure comprising:

(a) a skirt portion surmounted by an upstanding flange portion comprising an integral extended part, at least, in the shape of an inverted U and (b) a disc portion having an, at least, upward projection at the periphery of the disc said projection substantially confined between the integral extended part of the upstanding flange portion, said upstanding flange portion confining the projection swaged to offset the flange portion radially inwardly from the skirt portion at a point between the base of the skirt portion and the top of the flange portion, said offsetting forming a shoulder sufficiently wide to accommodate a duplicate skirt portion stacked thereon and said offset, upstanding flange imprinted at intervals on its outer surface with a crimp design and imprinted at sufficiently closer intervals on its inner surface with a crimp design to take up substantially all excess material from the swaging, said crimp design oriented to provide sufficient entry of air between closures when stacked thereby facilitating automatic destacking.

2. A two-piece closure of claim 1 in which the integral extended part of the upstanding flange comprises two 180° folds and the projection at the periphery of the disc is extended in the shape of an inverted U with the upstanding flange and the projection interfolded to interlock.

3. A closure of claim 1 wherein the imprinted crimp design is chosen from among an "H" pattern and an "I" pattern.

4. A closure of claim 2 wherein said imprinted crimp design is chosen from among an "H" pattern and an "I" pattern.

5. A closure of claim 1 wherein the faced surfaces of the upstanding flange portion and the upward projection at the periphery of the disc portion are coated with sufficient adhesive to bond these surfaces.

6. A closure of claim 1 comprising a plastic coated paperboard.

7. A closure of claim 1 comprising a cut-out section in the disc portion.

8. A closure of claim 2 comprising a cut-out section in the disc portion.

* * * * *